US006261251B1

(12) United States Patent
Meyers

(10) Patent No.: US 6,261,251 B1
(45) Date of Patent: Jul. 17, 2001

(54) J-SHAPED MASSAGE DEVICE HAVING A VIBRATOR

(76) Inventor: Andrew P. Meyers, 8763 Wonderland Park Ave., Los Angeles, CA (US) 90046

( * ) Notice: Subject to any disclaimer, the term of this patent is extended or adjusted under 35 U.S.C. 154(b) by 0 days.

(21) Appl. No.: 09/204,211

(22) Filed: Dec. 2, 1998

(51) Int. Cl.[7] ..... A61H 7/00

(52) U.S. Cl. ..... 601/135; 601/134; 601/137; 601/73; 601/72; 601/70

(58) Field of Search ..... 601/134, 135, 601/136, 137, 67, 69, 70, 72, 73, 78, 80, 81, 131

(56) References Cited

U.S. PATENT DOCUMENTS

D. 402,764 * 12/1998 Chatfield ..... D24/211
3,451,391 * 6/1969 Tavel ..... 601/80
4,878,489 * 11/1989 Kamayachi ..... 601/72
5,560,746 * 10/1996 Willow ..... 601/135
5,935,090 * 8/1999 Kennon ..... 601/135

* cited by examiner

*Primary Examiner*—Danton D. DeMille
*Assistant Examiner*—Benjamin K. Koo
(74) *Attorney, Agent, or Firm*—Fulbright & Jaworski L.L.P.

(57) ABSTRACT

A personal massage device that allows a person to apply a vibrating massage to his own back. The unique shape of the device allows the operator to hold it comfortably with one or both hands, while pressing the vibrating head of the device against his back. The device has a modified "J" shape, containing a straight main handle, a curved extension with a vibrator device located at the end, and a straight supplementary handle attached to the main handle at a right angle. A conveniently placed switch in the supplementary handle allows the operator to turn the vibrating device on or off while it is being held in its operating position. Interchangeable massage heads can be employed to vary the type of massage available from the device.

10 Claims, 6 Drawing Sheets

FIG. 2
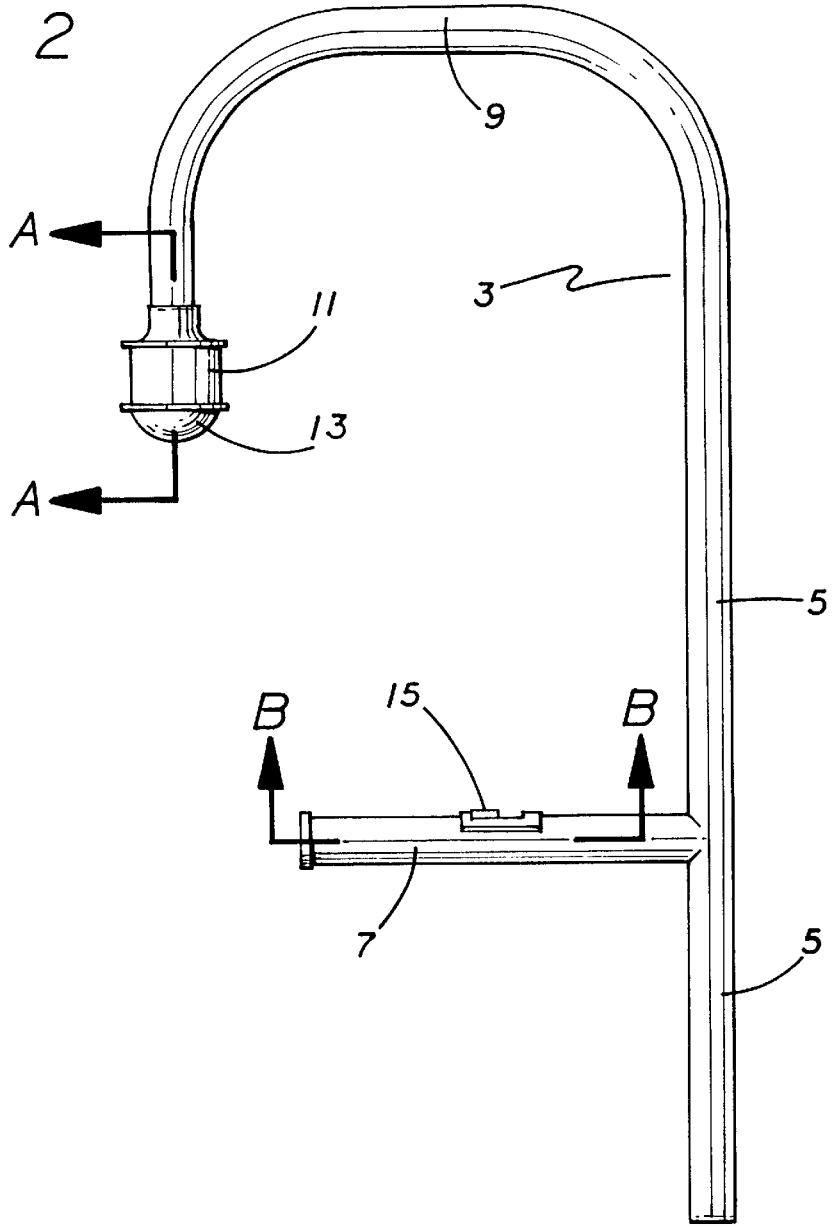
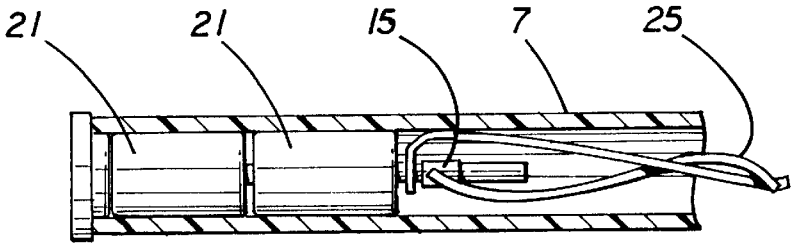
FIG. 4

FIG. 6
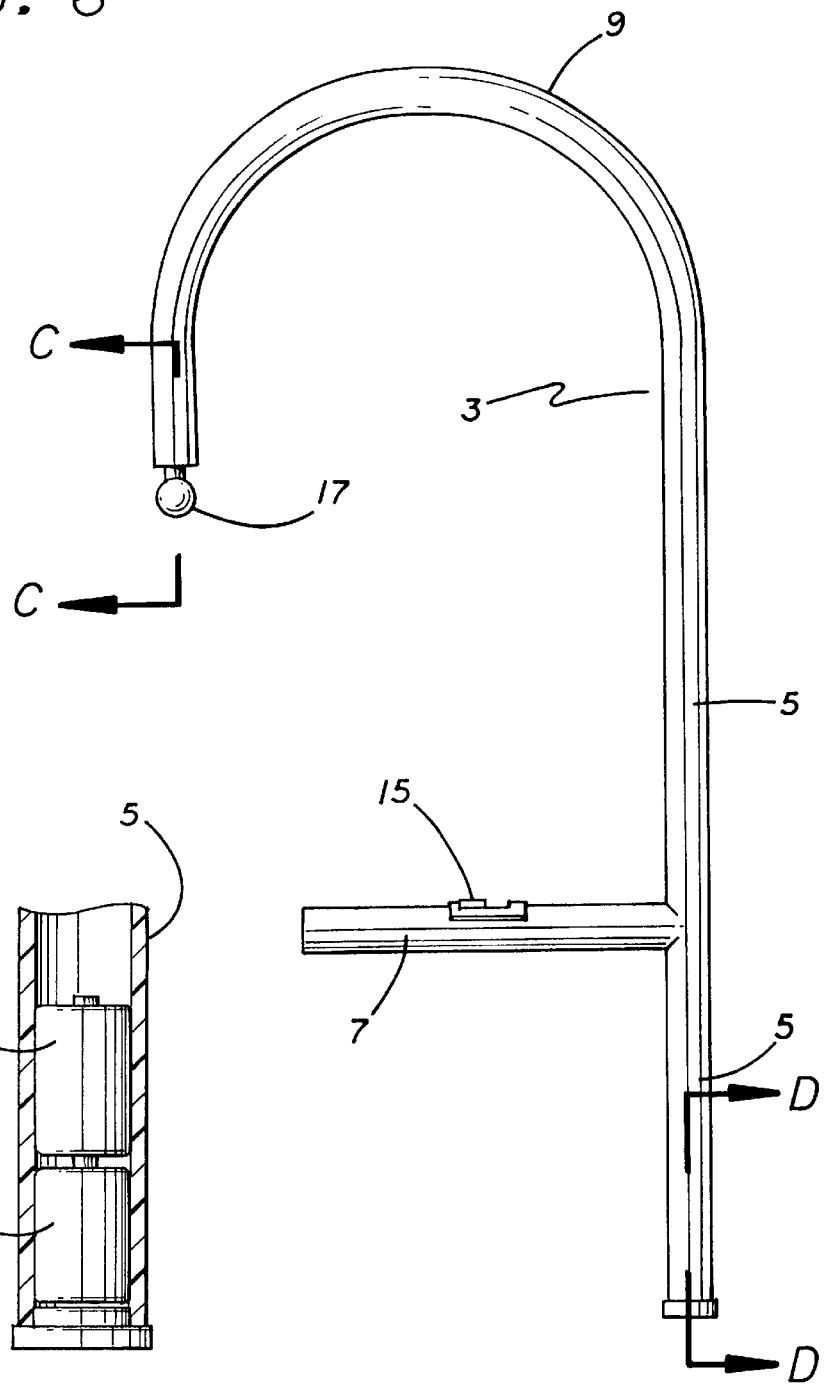
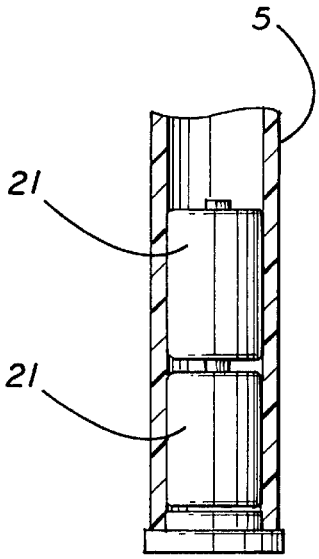
FIG. 8

J-SHAPED MASSAGE DEVICE HAVING A VIBRATOR

BACKGROUND OF THE INVENTION

1. Field of the Invention

The invention pertains to a personal massage device. More particularly, it pertains to a hand-held device that allows the operator to apply a vibrating massage to his or her own back.

2. Description of the Related Technology

Most modern personal massage devices are small, approximately a foot or less in length, with a vibrating device at one end, and with most of the remainder of the device designed as a handle for gripping with a single hand. Due to their short length, the operator cannot easily reach his or her own back with such a device, at least not without strained and awkward arm movements, and a second person is required if a back massage is to be administered. Unfortunately, many times a person desires a back massage when a second person is either unavailable or unwilling to help.

Various long-handled devices have been proposed which allow a person to apply pressure to his or her own back, and some have used wheeled or roller-type devices at the end to simulate a massaging action. But these have generally been purely mechanical devices with no automated massaging action, powered only by the operator's own muscles. Cesares (U.S. Pat. No. 4,266,536) suggests putting a vibrator at the end of one version of these mechanical devices, but gives no information as to the factors that would make such a combination optimal or even workable.

What is needed is a personal massage device that allows an individual to apply an automated vibrating massage to their own back without undue strain or awkwardness of arm placement, with design features to take advantage of the unique characteristics of vibrating back massage.

SUMMARY OF THE INVENTION

The invention includes a frame with a main handle and an offset extension, a vibrator device, a massage head located at the end of the extension, a power source, and a supplementary handle with a switch for turning the vibrator device on or off. The power source, such as one or more batteries, can be conveniently located at the end of one of the handles. The size and shape of the device allow an operator to apply a vibrating massage to his or her own back.

BRIEF DESCRIPTION OF THE DRAWINGS

FIG. 2 is a detailed view of the massager of FIG. 1.

FIG. 4 is a sectional view of the battery compartment of the massager of FIG. 1.

FIG. 6 is a detailed view of the massager of FIG. 5.

FIG. 8 is a sectional view of the battery compartment of the massager of FIG. 5.

DETAILED DESCRIPTION OF THE INVENTION

Figure 1:
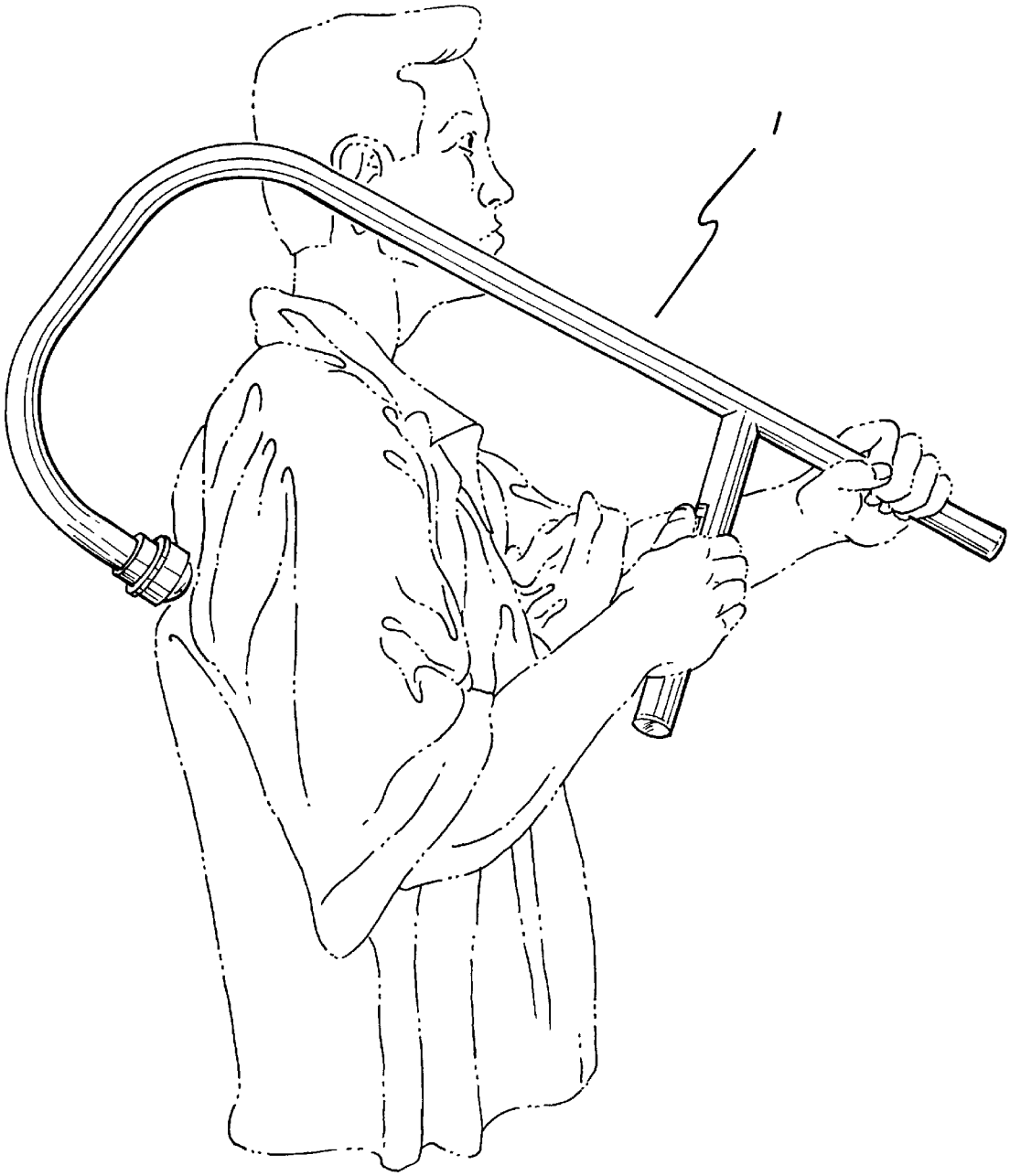
FIG. 1 is a view of one embodiment of the massager while in use.

As shown in FIG. 1, the present invention solves the aforementioned problems with conventional massagers by using a uniquely-shaped frame which allows the operator to conveniently and controllably hold the device in front of the face, shoulder, or chest, while applying the vibrating motion directly to the operator's back. This is accomplished by both the size and shape of the massager. In the embodiment shown in FIG. 2, massager 1 has a frame 3 with the overall shape of a "J", including a straight main handle 5 and a curved extension 9. Main handle 5 can provide a convenient place to grip the massager, while vibrator device 11 and hemispherical massage head 13 can be placed at the end of curved extension 9. This frame shape has at least three advantages: it places massage head 13 behind the operator while handle 5 is conveniently located in front of the operator, it allows massage head 13 to face back in the general direction of handle 5, and it offsets massage head 13 from the axis of handle 5 by approximately ten inches or more. This configuration allows the operator to hold main handle 5 so that it extends over the shoulder and behind the back as shown in FIG. 1, while curved extension 9 curls down toward the middle portions of the back, and reverses direction so that massage head 13 is facing forward. This placement puts message head 13 directly against the surface of the operator's back. Pressure can be exerted on the back by moving handle 5 forward, directly away from the operator. The operator can reach the lower part of the back by holding massager 1 so that main handle 5 extends under the arm and past the ribs.

Because of the leverage created by the overall length and offset of this design, a two-handed grip provides better control of the placement of message head 13. A primary embodiment therefore includes a supplementary handle 7, preferably extending at a right angle from main handle 5. This creates two gripping areas, at right angles to each other, and separated by several inches, which permits a great deal of flexibility in the way the massager can be held by the operator. The operator can control the pressure of the massage head against the back by simply pushing on supplementary handle 7 with the desired degree of force. Since this motion involves muscles on the front side of the body, there is no need to tense the back muscles, which would be counterproductive for a back massage. Supplementary handle 7 also provides leverage for the operator to rotate frame 3 around the axis of main handle 5, for more accurate placement of massage head 13. Both of the handles 5, 7 and the extension 9 can be made of rigid tubing, permitting light overall weight and allowing wires 25 to be run through the unit to connect the vibrator device 11, switch 15, and batteries 21.

The location of switch 15 is also important. While it can technically be placed almost anywhere in the unit, a preferred embodiment has it in supplementary handle 7 so that it is always easily accessible to the operator during use. Placing it on the side of handle 7 that faces the operator makes it conveniently thumb-operated. A three-position switch is preferred, with an "off" position and two "on" positions to permit control of a two-speed vibrator device for selecting high or low vibrator modes. Additional vibrator speeds can also be incorporated, by using a switch with more positions and a motor with more speeds.

The power source can be located in the end of either handle. By making the handles straight and tubular, they are inherently ready to serve as battery compartments for standard batteries 21. FIG. 4 shows an embodiment using supplementary handle 7 as a battery compartment, while FIG. 8 shows main handle 5 used for the same purpose. For more battery power and longer battery life, both handles can serve as battery compartments, with internal wires 25 extending to both handles. In an AC-powered version (not shown), the electric cord could extend from the end of either handle, As shown is FIG. 3, the massaging action comes from vibrator device 11 and massage head 13. A vibrator device typically contains an electric motor, an off-center linkage or weight that creates a vibrating action when the motor turns, and a connection to the massage head. These are common items in electrically-powered massagers and are not discussed herein in any greater detail.

Figure 3:
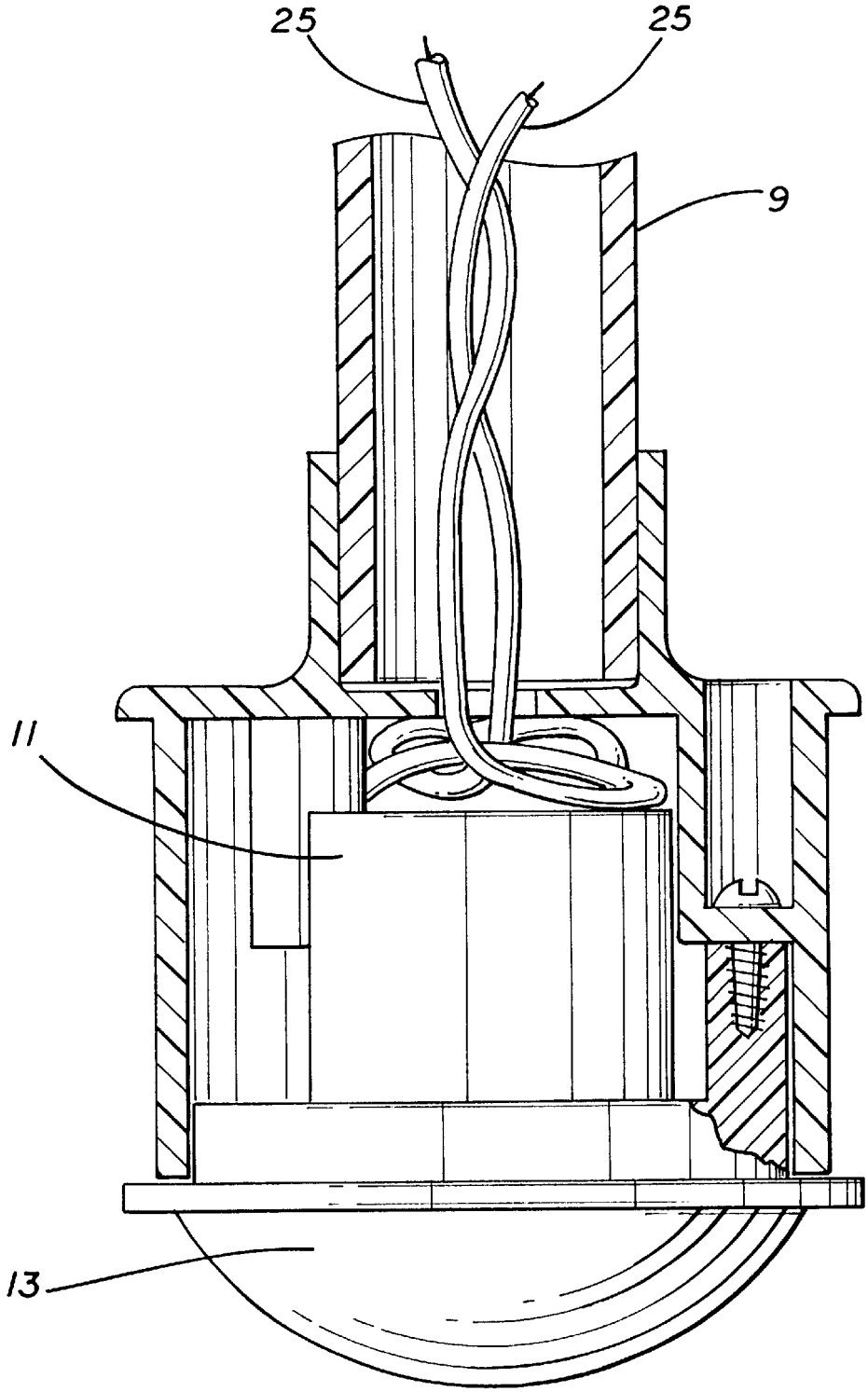
FIG. 3 is a sectional view of the vibrator of the massager of FIG. 1.
Figure 7:
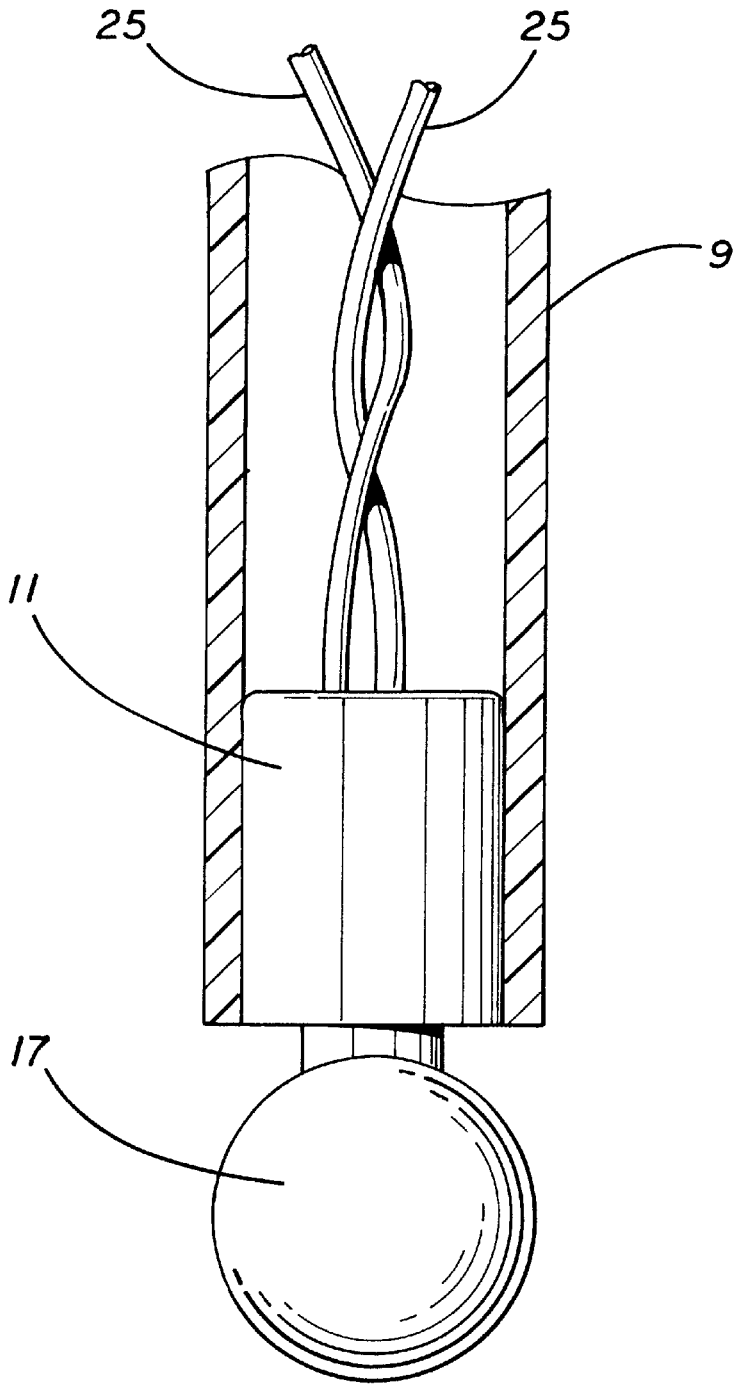
FIG. 7 is a sectional view of the vibrator of the massager of FIG. 5.

For greater flexibility, the massage head can be interchangeable. FIG. 3 shows a large hemispherical head 13, so-called because of its broad hemispherical contact surface. FIG. 7 shows a small concentrator massage head 17, so called because its small diameter concentrates the massage motion into a small contact area. Other configurations are also possible. Interchangeable massage heads are known, and the method of connection between the massage head and the vibrator device is not presented in detail.

Figure 5:
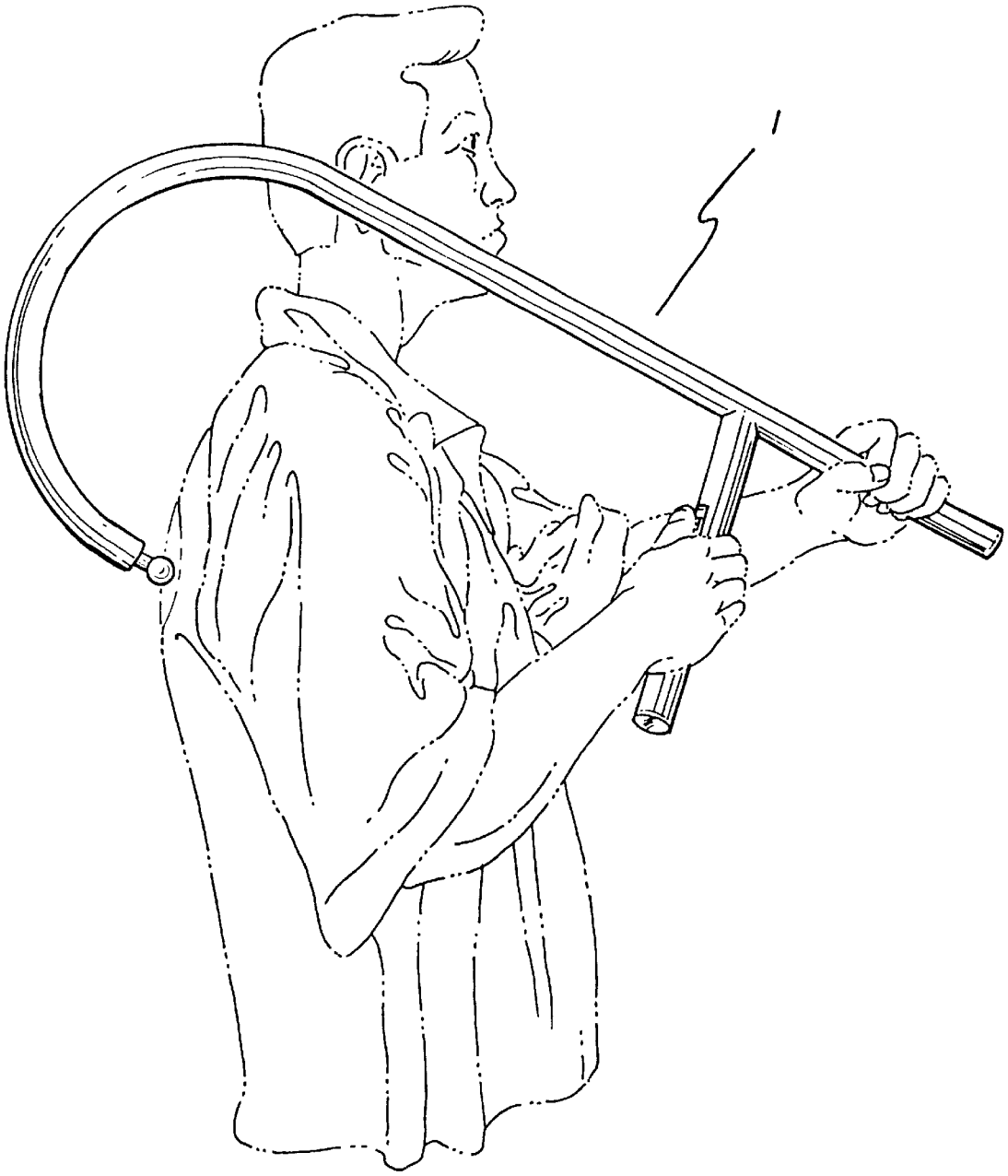
FIG. 5 is a view of a preferred embodiment of the massager while in use.

Two versions of extension 9 are shown. FIG. 5 shows a continuously curved shape, while FIG. 1 shows two smaller radius curves connected with a straight portion. Neither is inherently superior to the other in operation, and the choice is mainly a matter of aesthetic appeal or manufacturing considerations. Frame 3 can be assembled from a number of smaller parts, or molded as a single unit.

Since massager 1 is designed to be ergonomically correct for its intended application, its dimensions are important. In a preferred embodiment, main handle 5 is at least eighteen inches long from its end to the point of connection with extension 9 so that it can reach behind the operator. Extension 9 should offset massage head 13 at least ten inches from the axis of main handle 5 so that the massage head can reach the middle of the operator's back. Supplementary handle 7 should be at least six inches long to provide sufficient gripping surface for one band, and main handle 5 should extend at least six inches past its point of connection with supplementary handle 7 to provide sufficient gripping surface for the other hand.

The foregoing description is intended to be illustrative and not limiting. Obvious variations will occur to those of skill in the art. The invention is intended to encompass all such variations and be limited only by the scope and spirit of the appended claims.

What is claimed is:

1. A personal massage device, comprising:

a rigid J-shaped frame having a first handle at one end, and a curved extension at the other end, said curved extension having a free end, said massage head including a vibrator device and a rounded tip;

a second handle attached to the first handle, one end of the second handle being connected to the first handle at approximately a right angle, and the other end of the second handle remaining unattached, said second handle including a battery adapted to power the vibrator device and a switch for controlling the vibrator device, wherein the frame is adapted for placing the rounded tip of the massage head firmly against an operator's back while holding the first handle and the second handle in front of the operator.

2. The device of claim 1, wherein the second handle is at least six inches long.

3. The device of claim 1, wherein the second handle is connected to the first handle at least six inches from an end of the first handle.

4. The device of claim 1, wherein the switch includes an 'off' position and two 'on' positions.

5. The device of claim 1, wherein the massage head is detachably coupled to the vibrator device.

6. The device of claim 1, wherein an outer surface of the massage head has a large, approximately hemispheric shape.

7. The device of claim 1, wherein an outer surface of the massage head has a small ball shape.

8. The device of claim 1, wherein the frame includes tubular material.

9. The device of claim 1, wherein the first handle is at least eighteen inches long.

10. The device of claim 1, wherein the extension offsets the massage head at least ten inches from an axis of the first handle.

* * * * *